US009862461B2

(12) United States Patent
Cao

(10) Patent No.: US 9,862,461 B2
(45) Date of Patent: Jan. 9, 2018

(54) EXTENDABLE AND RETRACTABLE BOAT AWNING

(71) Applicant: John Cao, Boca Raton, FL (US)

(72) Inventor: John Cao, Boca Raton, FL (US)

( * ) Notice: Subject to any disclaimer, the term of this patent is extended or adjusted under 35 U.S.C. 154(b) by 0 days.

(21) Appl. No.: 15/172,460

(22) Filed: Jun. 3, 2016

(65) Prior Publication Data

US 2017/0349241 A1 Dec. 7, 2017

(51) Int. Cl.
*B63B 17/02* (2006.01)
*E04H 15/06* (2006.01)

(52) U.S. Cl.
CPC ..... *B63B 17/02* (2013.01)

(58) Field of Classification Search
CPC ... B63B 17/02; B63B 2017/026; E04H 15/06; E04H 15/08; E04H 15/34; E04H 15/46
See application file for complete search history.

(56) References Cited

U.S. PATENT DOCUMENTS 2,335,752 A * 11/1943 Geiger ..... A01K 89/015 242/255
3,034,741 A * 5/1962 Macy ..... A01K 89/0102 242/240
3,069,109 A * 12/1962 Golec ..... A01K 89/0102 242/239
6,439,150 B1 8/2002 Murphy et al.
7,093,558 B1 8/2006 Mandanici
7,395,774 B2 7/2008 Borges et al.
7,571,691 B2 8/2009 Russikoff
7,895,964 B2 3/2011 Russikoff
2008/0296114 A1* 12/2008 Chen ..... E01F 13/048 192/20
2011/0290170 A1 12/2011 Russikoff
2013/0206050 A1 8/2013 Russikoff

* cited by examiner

*Primary Examiner* — Anthony D Wiest
(74) *Attorney, Agent, or Firm* — Robert M. Downey, P.A.

(57) ABSTRACT

An awning for a boat is operable between retracted and extended positions and includes a frame structure having left and right telescopically extendable and retractable tube assemblies each having a fixed tube, a telescopic mid tube and a telescopic end tube. Cross tubes extend transversely between each of the mid tubes and the end tubes. A canvas roller is mounted transversely between the fixed tubes. A sheet of marine canvas is secured to the roller and the end cross tube and is rolled onto the roller when the awning is retracted. A gear box disengages the canvas roller to allow the telescoping tube assemblies and canvas to be manually extended. To retract the awning, the gear box is engaged with the canvas roller and a removable crank handle is operated to rotate the roller and roll up the canvas as the frame structure is telescopically retracted.

6 Claims, 21 Drawing Sheets

EXTENDABLE AND RETRACTABLE BOAT AWNING

BACKGROUND OF THE INVENTION

Field of the Invention

The present invention relates to bimini tops and awnings for boats, and more particularly to an extendable and retractable awning that mounts to an overhead structure on a boat.

Discussion of the Related Art

Getting out on a boat to go fishing, diving, swimming or simply cruising is usually a very enjoyable experience. However, it is extremely important to take precautions and to be prepared to avoid excessive exposure to the elements, particularly the sun. While many recreational boats are equipped with hard tops (i.e., fiber glass) or canvas tops that help to block the sun's light, in many instances the shade provided by these overhead structures is limited to seating areas directly around the helm. As a result of the limited area of shade on many recreational boats, boater owners and their guests are often exposed to direct sunlight for extended periods of time which is not only uncomfortable, but can cause severe sunburn. Naturally, excessive exposure to direct sunlight also increases the likelihood of developing skin cancer.

While others have proposed various solutions to extending the area of shade provided on recreational boats, including extendable and retractable bimini tops, these structures are not always capable of being deployed (i.e., extended) when the boat is traveling at higher cruising speeds. This can be due to either a weak frame structure, or excessive weight that causes stress on the bimini top when a boat is traveling at higher speeds, particularly at speeds in excess of 25 knots. For instance, many extendable and retractable bimini tops include heavy springs and other hardware that increases the overall weight of the assembly. When extended, the bimini top is essentially a cantilever that will flex when the boat is traveling at higher cruising speeds, especially when in choppy or rough seas. Under these conditions, the extended bimini top may not be able to withstand flexing and bending forces due to the excessive weight of springs and other hardware.

Accordingly, there remains a definite need for an extendable and retractable awning assembly for a boat that is strong, lightweight and very easy to operate. Moreover, there is a need for a lightweight and strong boat awning that can remain in an extended position while cruising at full speed.

SUMMARY OF THE INVENTION

The present invention is directed to an awning for mounting to an overhead structure (e.g., hard top or canvas top) on a boat. The awning is operable between a retracted position and an extended position and includes a frame structure that has left and right telescoping parallel tube assemblies. Each tube assembly includes a fixed tube, a telescopically movable mid tube and a telescopically movable end tube. Cross tubes extend transversely between each of the mid tubes and the end tubes, and a canvas roller is secured transversely between the fixed tubes of the left and right tube assemblies. A sheet of marine canvas is secured to the roller and the end cross tube and is rolled onto the roller when the awning is retracted. A gear box assembly disengages with the canvas roller to allow the telescoping tube assemblies to be manually pulled out in order to unroll the canvas and extend the awning. To retract the awning, the gear box is engaged with the canvas roller and a crank handle is operated to drivingly rotate the roller and roll up the canvas as the mid and end tubes of the frame structure are telescopically retracted.

OBJECTS AND ADVANTAGES OF THE INVENTION

Considering the forgoing, it is a primary object of the present invention to provide an extendable and retractable awning assembly for installation on a boat, wherein the awning assembly is structured to remain in an extended, deployed position while the boat is traveling at full speed (i.e., when the awning assembly is mounted and extended towards the stern).

It is a further object of the present invention to provide an extendable and retractable awning assembly for installation on a boat, and wherein the awning assembly is structured to be strong and lightweight, and further wherein the awning assembly avoids the need for springs or excess hardware thereby minimizing the overall weight of the assembly.

It is still a further object of the present invention to provide an extendable and retractable awning structure for installation on a boat, and wherein the awning structure is adapted to be mounted towards the stern side and/or the bow side of a canvas top or hard top on the boat.

It is still a further object of the present invention to provide an extendable and retractable boat awning assembly for installation on a boat, and wherein the awning assembly is easily and quickly extended by simply pulling and extending the frame structure by hand with a canvas roller in free spool, and further wherein the awning assembly includes a gear box for engaging the roller to retract the awning assembly and roll up the canvas.

It is still a further object of the present invention to provide an extendable and retractable awning assembly for installation on a boat, and wherein the gear box is operable with the use of a removable crank handle for safety and convenience.

It is still a further object of the present invention to provide an extendable and retractable boat awning for installation on a boat that can be fully extended or partially extended.

It is yet a further object of the present invention to provide an extendable and retractable awning assembly for installation on a boat, and wherein the awning assembly is built to withstand the harsh marine environment.

It is yet a further object of the present invention to provide an extendable and retractable boat awning assembly that is structured to be easily extended and retracted in a matter of seconds.

It is still a further object of the present invention to provide an extendable and retractable awning assembly for installation on a boat, and wherein the awning assembly is adapted to be customized to fit a wide variety of boat tops (both canvas tops and hard tops) up to 70 inches in width.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
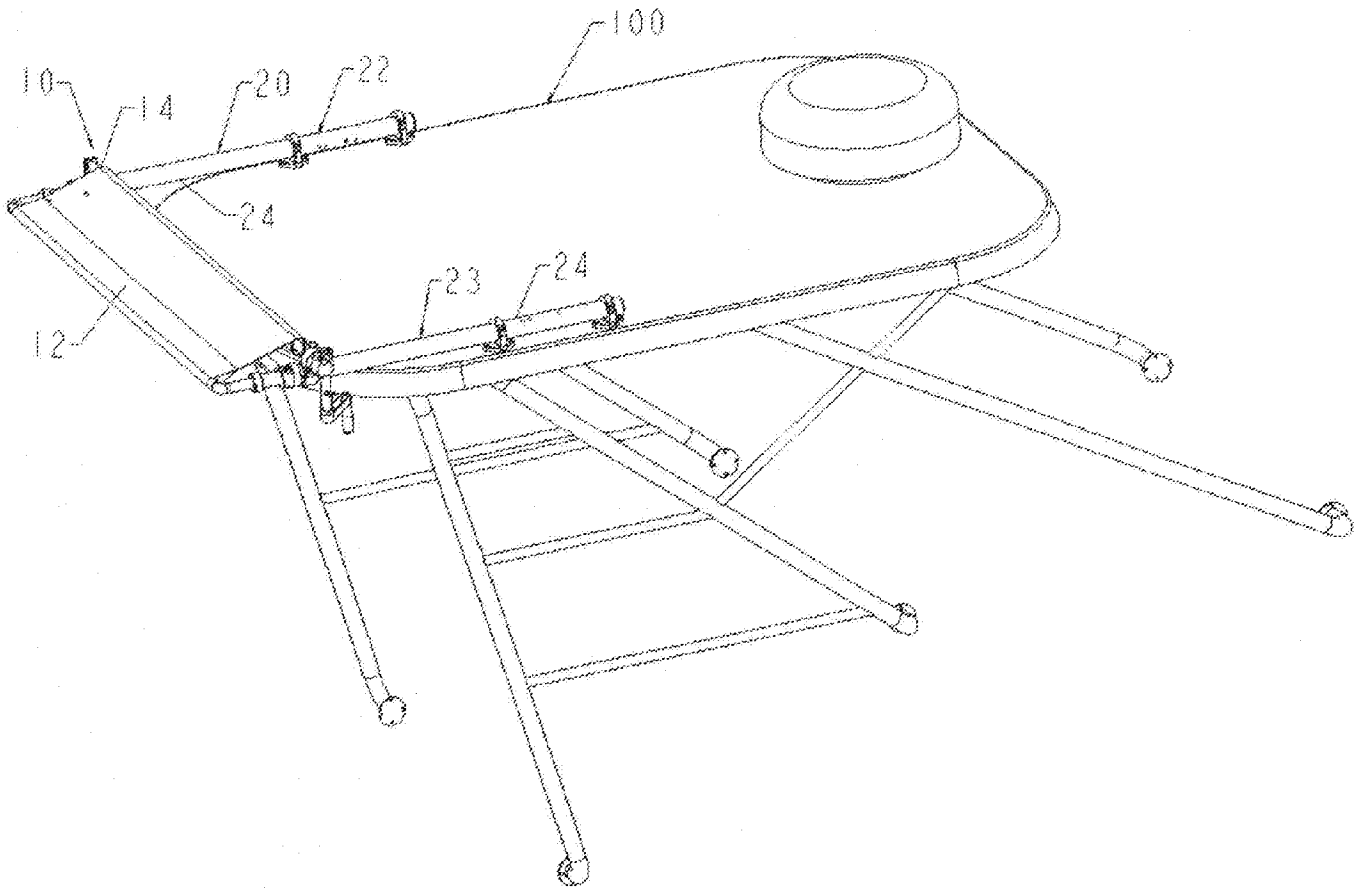
FIG. 1 is a perspective view showing the awning assembly of the present invention installed on a hard top of a recreational boat.
Figure 2:
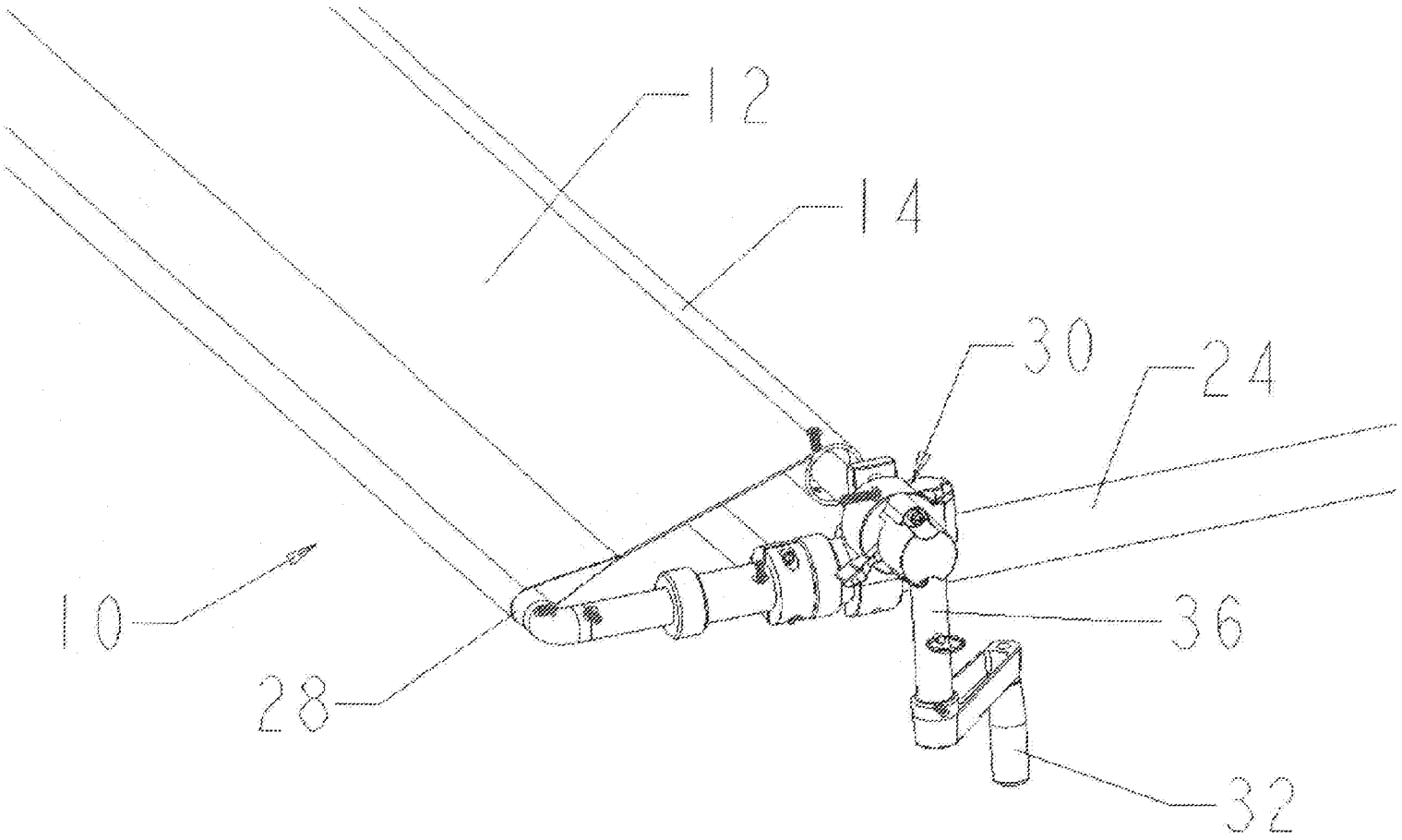
FIG. 2 is an isolated perspective view taken from FIG. 1 showing a gear box assembly, crank handle and canvas roller of the awning assembly.
Figure 3:
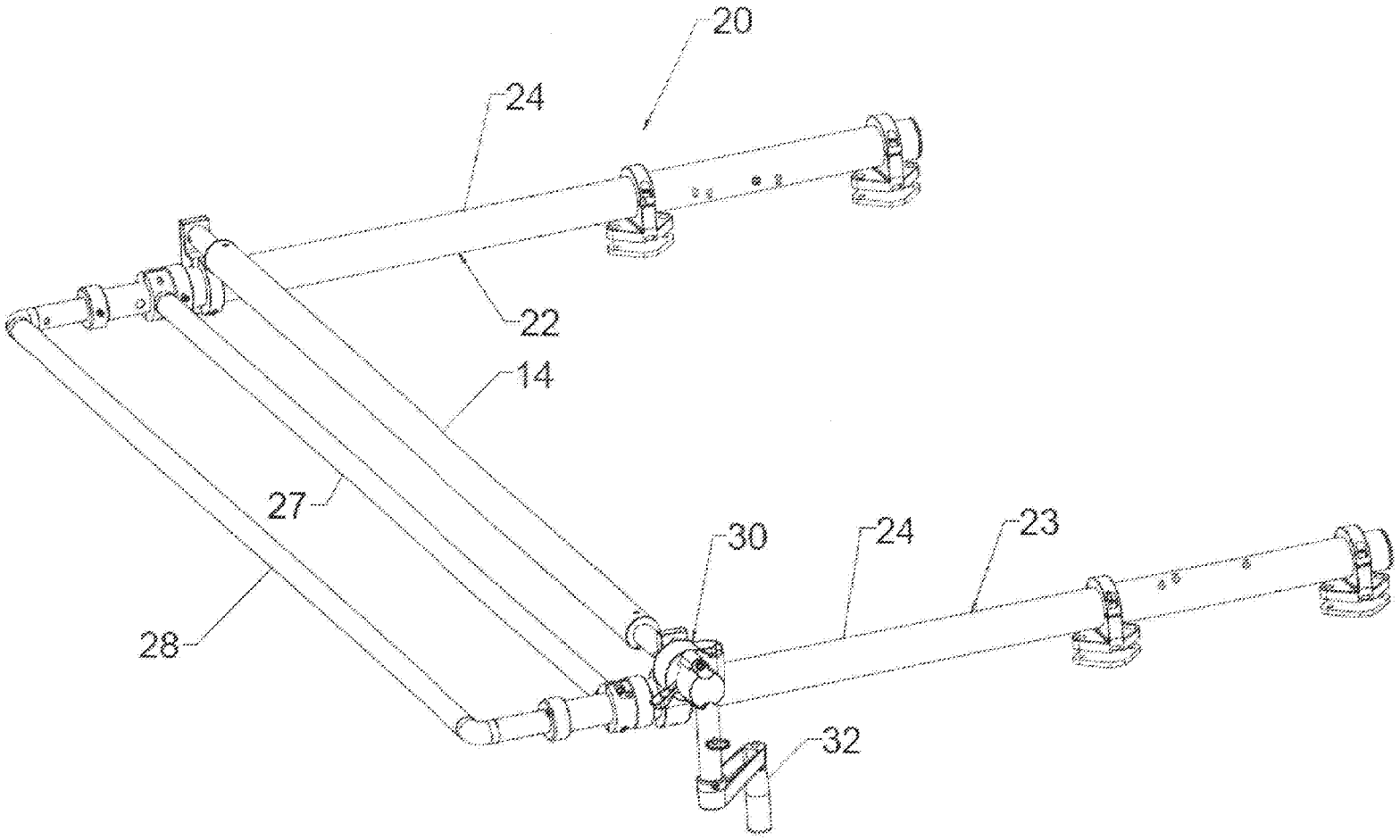
FIG. 3 is a top perspective view showing a frame structure of the awning assembly in a retracted position.
Figure 4:
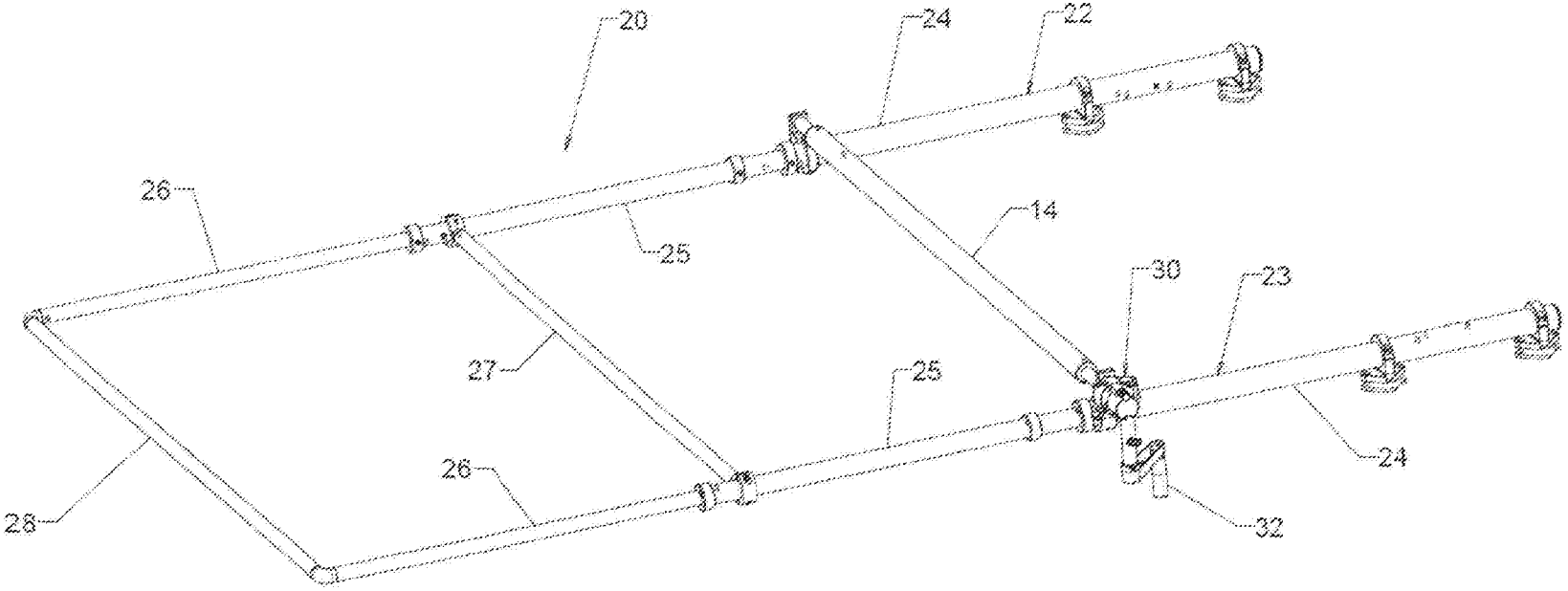
FIG. 4 is a perspective view showing the frame structure of the awning assembly in a fully extended position.

Referring to the several views of the drawings, and initially FIGS. 1-4, the extendable and retractable awning assembly of the present invention is shown and is generally indicated as 10. As seen in FIG. 1, the awning assembly 10 is intended to be mounted to an overhead structure 100 on a boat, such as a hard top or a canvas top. The awning assembly 10 includes a canvas sheet 12 that is rolled onto a canvas roller 14. As seen in FIGS. 3 and 4, the awning assembly also includes a frame structure 20 that is extendable and retractable. The frame structure 20 includes left and right telescoping tube assemblies 22 and 23 that are maintained in spaced, parallel relation to one another. Each of the tube assemblies includes a fixed or stationary tube 24, a telescoping mid tube 25 and a telescoping end tube 26. The frame assembly 20 further includes a mid cross tube 27 extending between the parallel left and right tube assemblies and specifically connecting to each of the mid tubes of the parallel tube assemblies 22, 23. An end cross tube 28 extends between the distal ends of the telescopic end tubes 26 of the parallel left and right tube assemblies. The canvas roller 14 is mounted to the frame structure and extends transversely between the stationary tubes 24 of each of the parallel tube assemblies, as seen in FIGS. 3 and 4. A gear box assembly 30 with a removable crank handle 32 is mounted to one of the stationary tubes 24 and is adapted for engagement and disengagement with the canvas roller 14 for rolling the canvas 12 onto the canvas roller 14 while moving the frame structure 20 from the extended position seen in FIG. 4, to the retracted position as seen in FIGS. 1 and 3.

Figure 5:
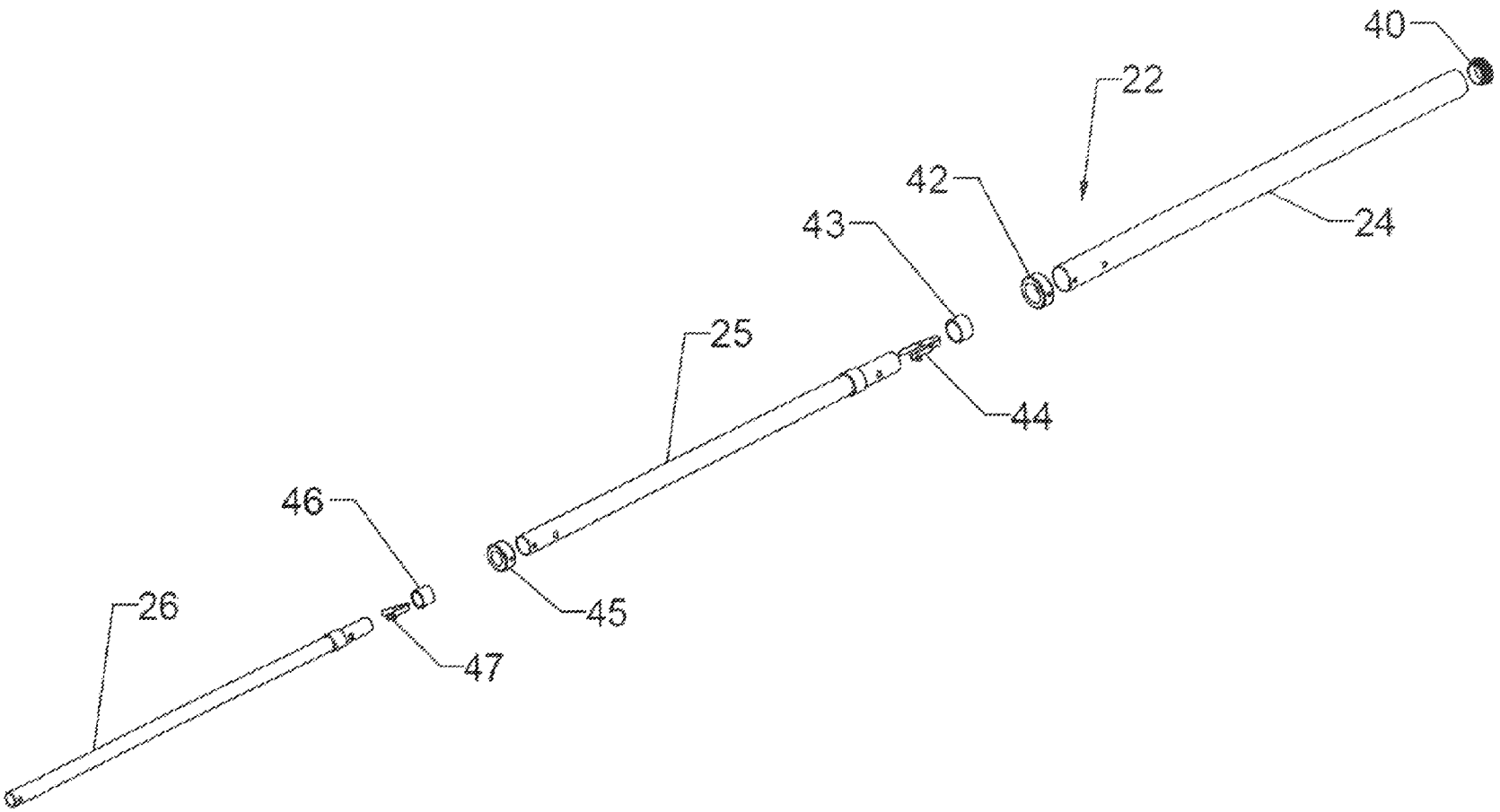
FIG. 5 is an exploded perspective view of one of the telescoping tube assemblies of the frame structure including a stationary tube, a mid telescopic tube and an end telescopic tube.

Referring to FIG. 5, an exploded view of one of the tube assemblies is shown and includes the stationary tube 24, the mid telescopic tube 25 and the end telescopic tube 26. The one end of the stationary tube 24 includes an end cap 40. A bushing 42 is fitted to the opposite end of the stationary tube and allows for smooth, guided and sliding passage of the mid tube 25 into and out of the stationary tube 24. A bushing sleeve 43 on the mid tube 25 further allows for guided, stable passage of the mid tube within the interior of the stationary tube without wobbling. Once extended, the mid tube 25 is locked into place and fixed relative to the stationary tube 24 with the use of a snap button spring 44. Specifically, the snap button spring 44 engages within aligned holes on the stationary tube and the mid tube. The opposite end of the mid tube is fitted with a bushing 45 that allows for guided sliding passage of the end tube 26 within the mid tube 25. The proximal end of the end tube 26 is fitted with a bushing sleeve 46 to allow for stabilized sliding movement of the end tube within the mid tube, without wobbling, during telescopic extension and retraction of the end tube relative to the mid tube. When the end tube 26 is fully extended, a snap button spring 47 engages within aligned holes of the mid tube 25 and the end tube 26 to lock the end tube in the extended position.

Figure 6:
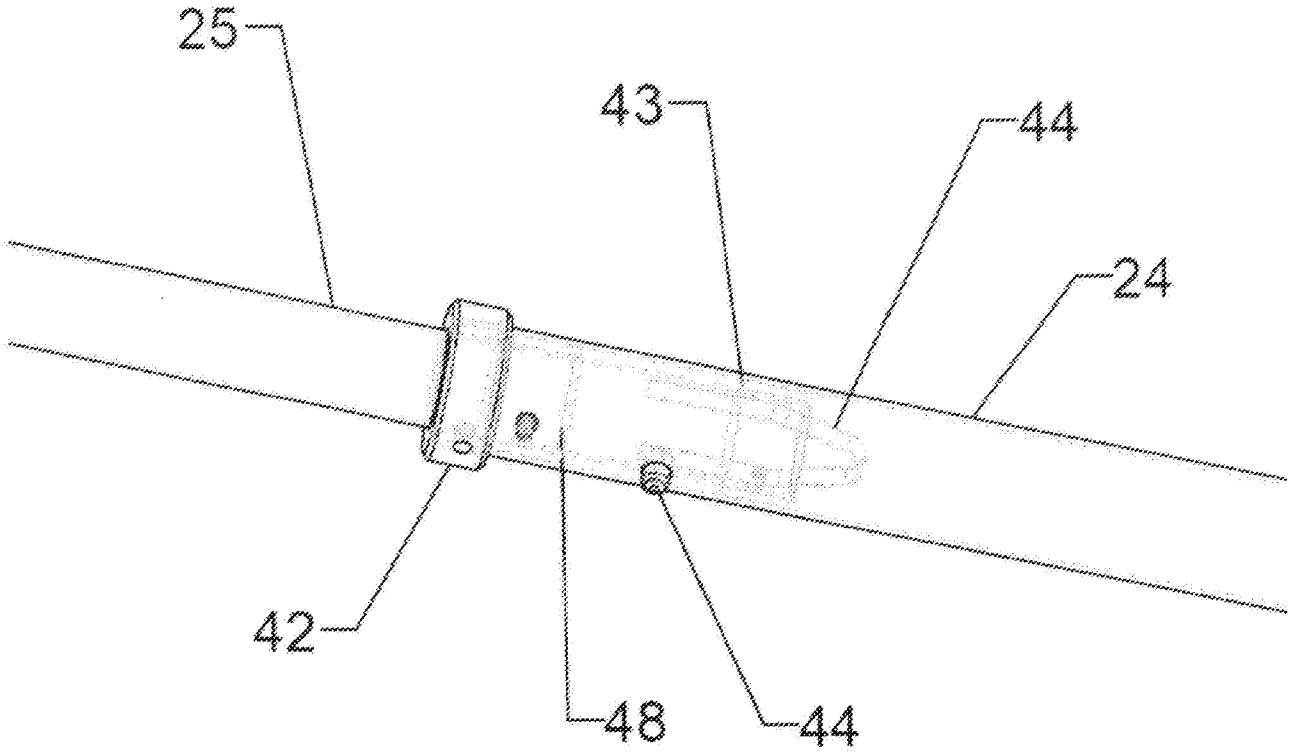
FIG. 6 is an isolated perspective view, in partial cutaway, showing an end of the mid telescopic tube within the stationary tube and including an interior sleeve bushing for providing a hard stop that allows a snap button spring to align with a locking hole on the stationary tube each time the mid telescopic tube is fully extended (the juncture of the mid telescopic tube and end telescopic tube having the same snap button spring and interior sleeve bushing arrangement)

Referring to FIG. 6, a second sleeve bushing 48 may be fitted to the end of the mid tube 25 within the stationary tube 24, as well as the end of the end tube within the mid tube, to provide a hard stop when the mid tube 25 is fully extended relative to the stationary tube 24 and also when the end tube 26 is fully extended relative to the mid tube 25, thereby assuring proper alignment of the holes for engagement of the snap button springs 44, 47 within the align holes each time the mid tube 25 and the end tube 26 of the tube assemblies are fully extended.

Figure 7:
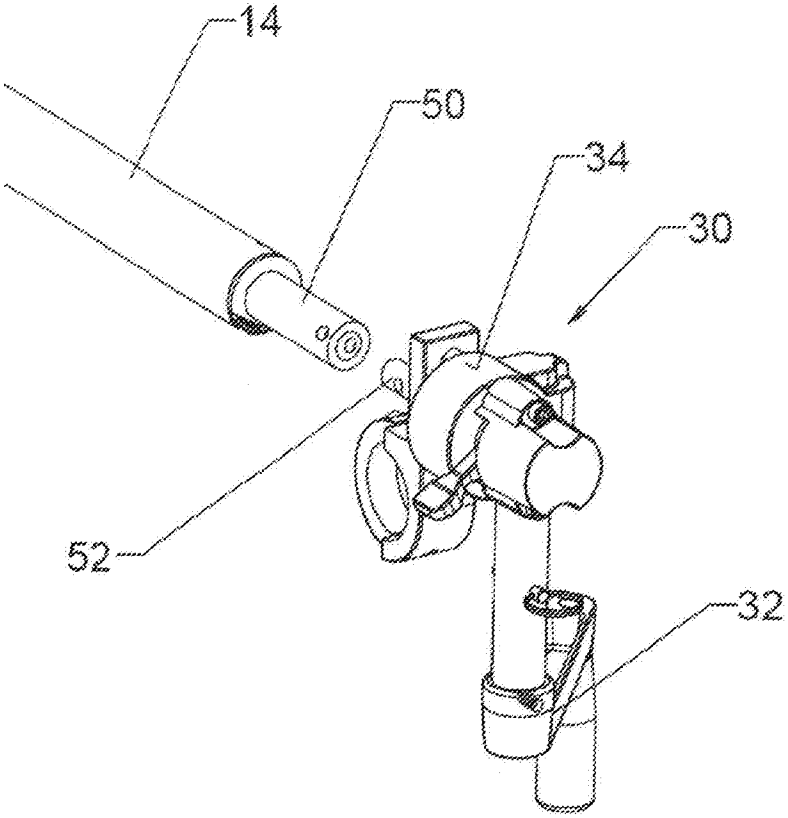
FIG. 7 is a partially exploded perspective view showing connection of a roller tube assembly to the gear box assembly with the use of a pin connector and gudgeon.

Referring to FIG. 7, the canvas roller 14 includes a gudgeon 50 fitted to each end. The gudgeon 50 at one end of the canvas roller attaches to a pin connector 52 of the gear box assembly 30. In a preferred embodiment, as shown in FIG. 7, a screw is used to fasten the pin connector 52 to the gudgeon 50. Accordingly, the roller assembly 14 is connected to the gear box assembly 30 by the pin connector 52 which engages and disengages with a drive pin 33 in the gear box assembly as described in more detail hereinafter.

Figure 8:
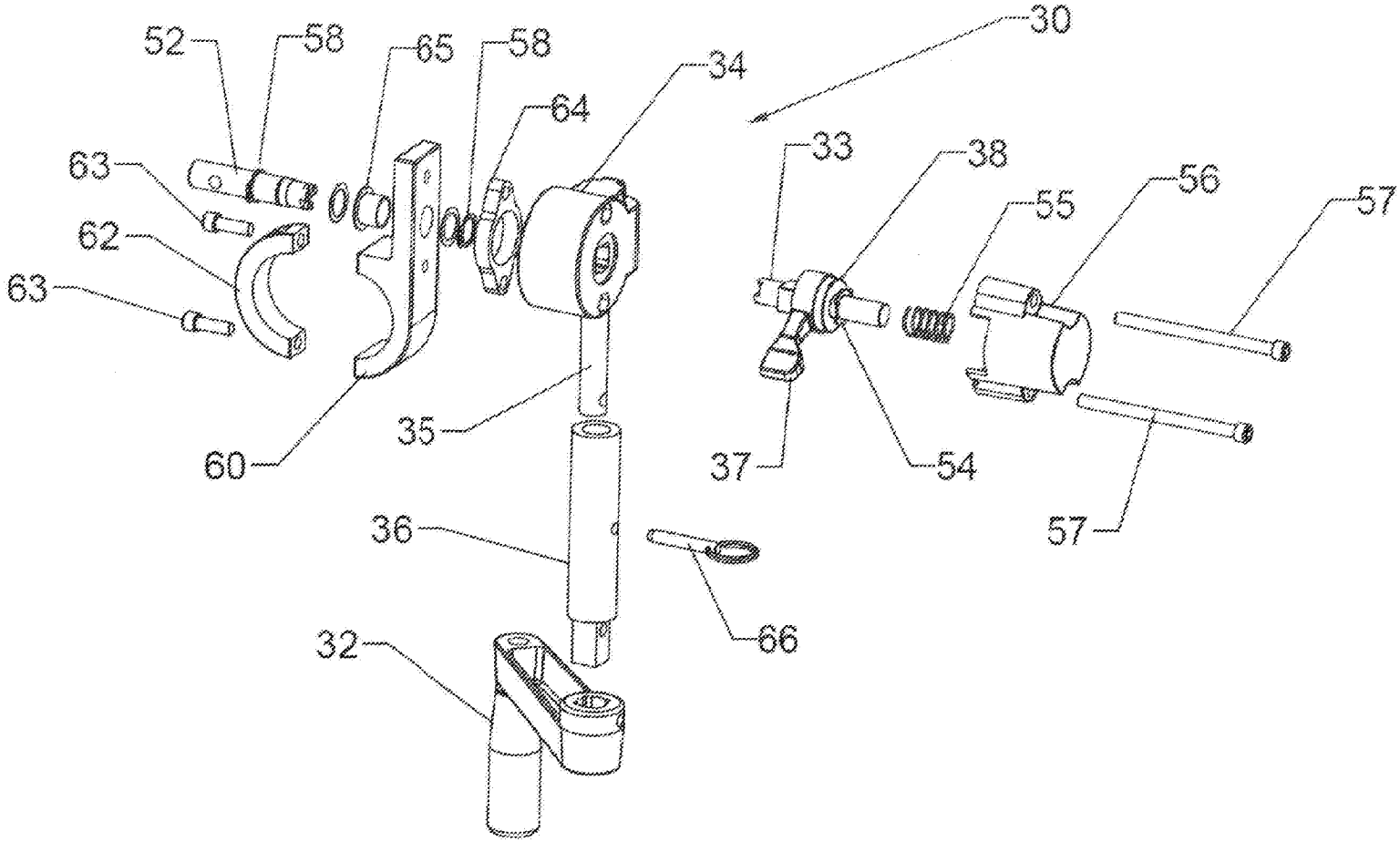
FIG. 8 is an exploded perspective view of the entire gear box assembly including a removable crank handle and a mounting bracket for mounting the gear box assembly to the stationary tube of the frame structure.

Referring to FIG. 8, an exploded view of the gear box assembly 30 is shown and includes a gear box 34 with a through passage for receipt of the drive pin 33. A gear shaft 35 extends from the bottom of the gear box 34 and is adapted for attachment to the crank handle 32. The crank handle 32 may further be fitted with a spacer handle 36 to provide sufficient distance between the crank handle 32 and the gear box to avoid interference when operating the crank handle in order to drive the gear box assembly, as described more full hereinafter. The gear box assembly 30 further includes a lever 37 that engages with a cam 38. The drive pin 33 extends through the lever 37 and cam 38 and includes an E-clip 54 for engagement with a compression spring 55. A cover 56 is fitted over the lever, cam, drive pin and compression spring and is secured to the gear box 34 with the use of cap screws 57. The gear box assembly 30 is mounted to the stationary tube 24 on the frame structure 20 with the use of a bracket including a first bracket member 60 and an opposing C-bracket member 62 that is secured to the first bracket member 60 with the use of cap screws 63. The gear box assembly 30 further includes a spacer 64, a flange bushing 65 and the pin connector 52 which freely rotates within the flange bushing. The pin connector 52 is secured within bracket member 60 with snap rings 58. The crank handle 32 is removably secured to the gear shaft 35 of the gear box 34 with the use of a quick release pin 66.

Figure 9:
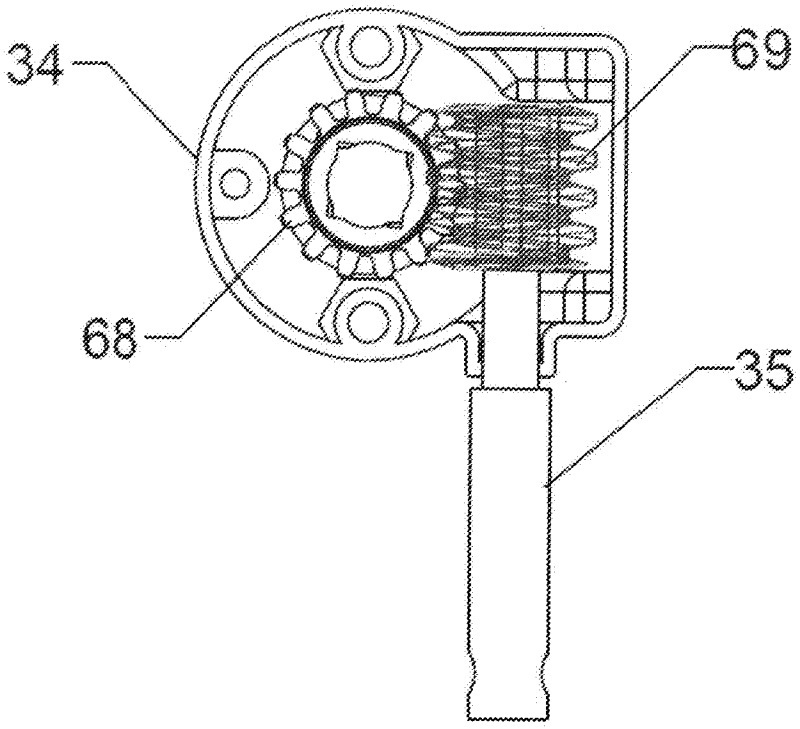
FIG. 9 is a perspective view showing an interior of the gear box including a pinion gear and a worm gear.

As seen in FIG. 9, the interior of the gear box 34 includes a pinion gear 68 that intermeshes with a worm gear 69 driven by the gear shaft 35 extending from the bottom of the gear box. The combination of the pinion gear 68 and worm gear 69 provide the desired gear ratio for drivingly rotating the canvas roller tube 14.

The sheet of canvas 12 is secured to both the roller 14 at one end and to the end cross tube 28 at the opposite end of the canvas sheet. More specifically, one end of the canvas sheet 12 is formed to have a loop or sleeve which slides over the end cross tube 28 of the frame structure. The opposite end of the canvas sheet 12 may be fitted with a plastic strip (not shown) which is sewn or stapled into the canvas and the canvas and plastic strip slide into a groove (not shown) in the roller 14 to thereby effectively secure the end of the canvas sheet 12 to the roller 14.

Figure 10:
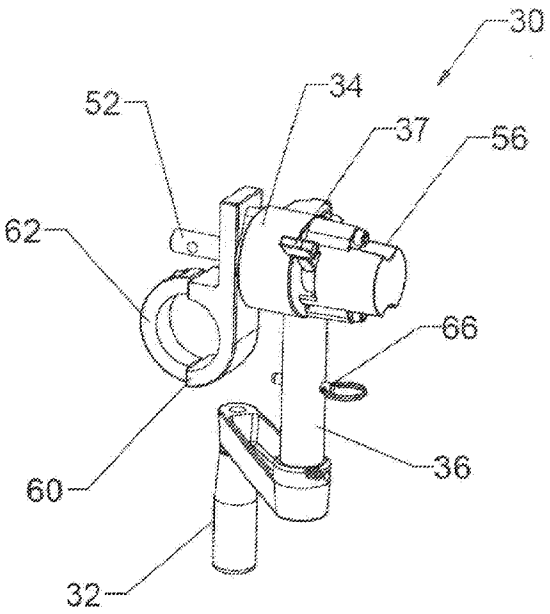
FIG. 10 is a perspective view of the gear box assembly including the removable crank handle and mounting bracket.
Figure 11:
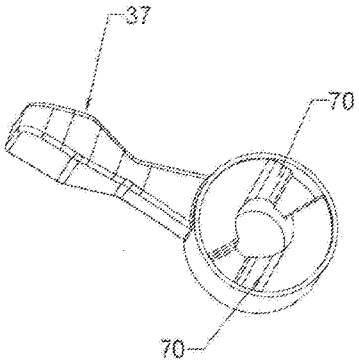
FIG. 11 is a perspective view of a lever taken from the gear box assembly.
Figure 12:
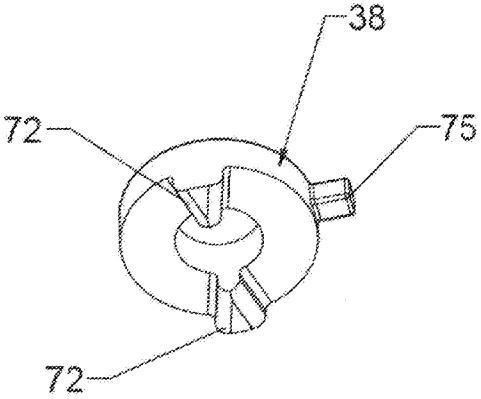
FIG. 12 is a perspective view of a cam of the gear box assembly.
Figure 14:
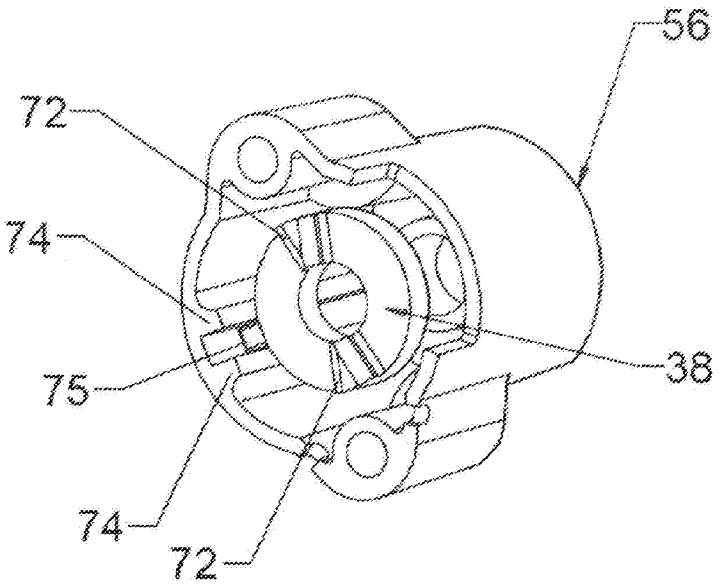
FIG. 14 is a perspective view showing the inside of the cover of the gear box assembly with the cam of FIG. 12 fitted therein.
Figure 13:
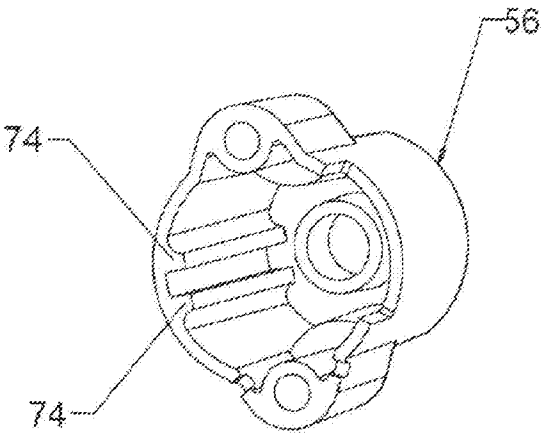
FIG. 13 is a perspective view showing an inside of the cover of the gear box assembly.
Figure 16:
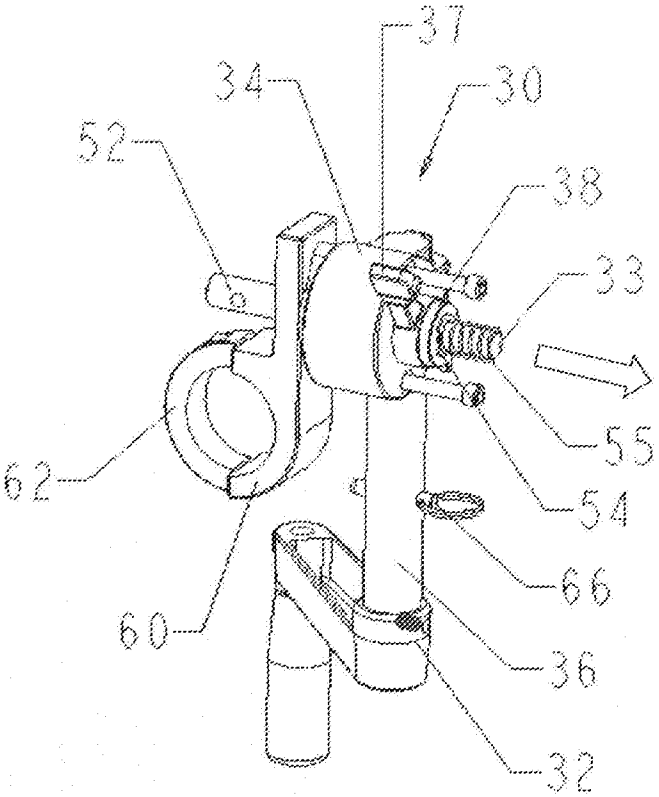
FIG. 16 is an isolated perspective view of the gear box assembly with the cover removed and showing the lever in the raised up position and urging the cam outwardly against the compression spring, thereby disengaging the drive pin from the pin connector on the canvas roller.
Figure 15:
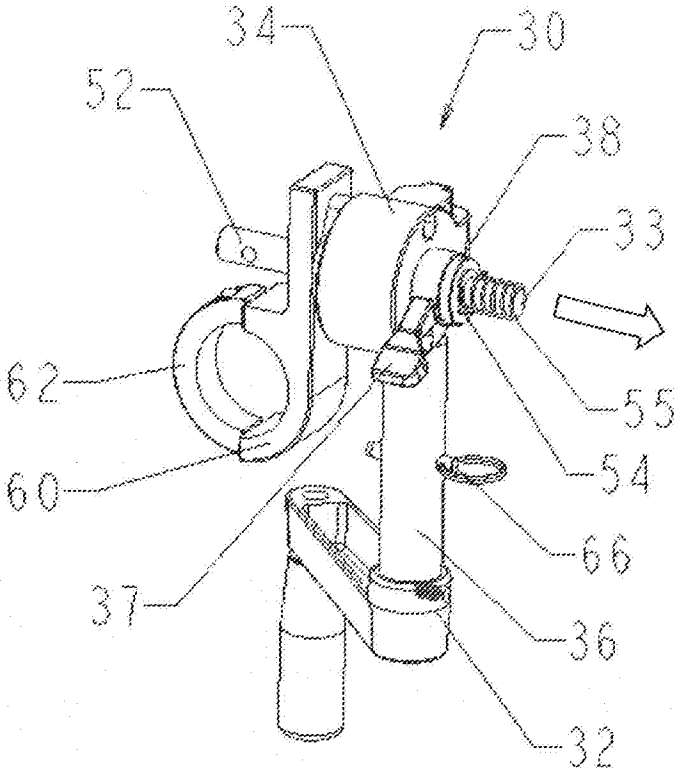
FIG. 15 is a perspective view of the gear box assembly and crank lever with the cover removed and showing the lever in the down position to engage the drive pin of the gear box assembly with the pin connector of the canvas roller.
Figure 17:
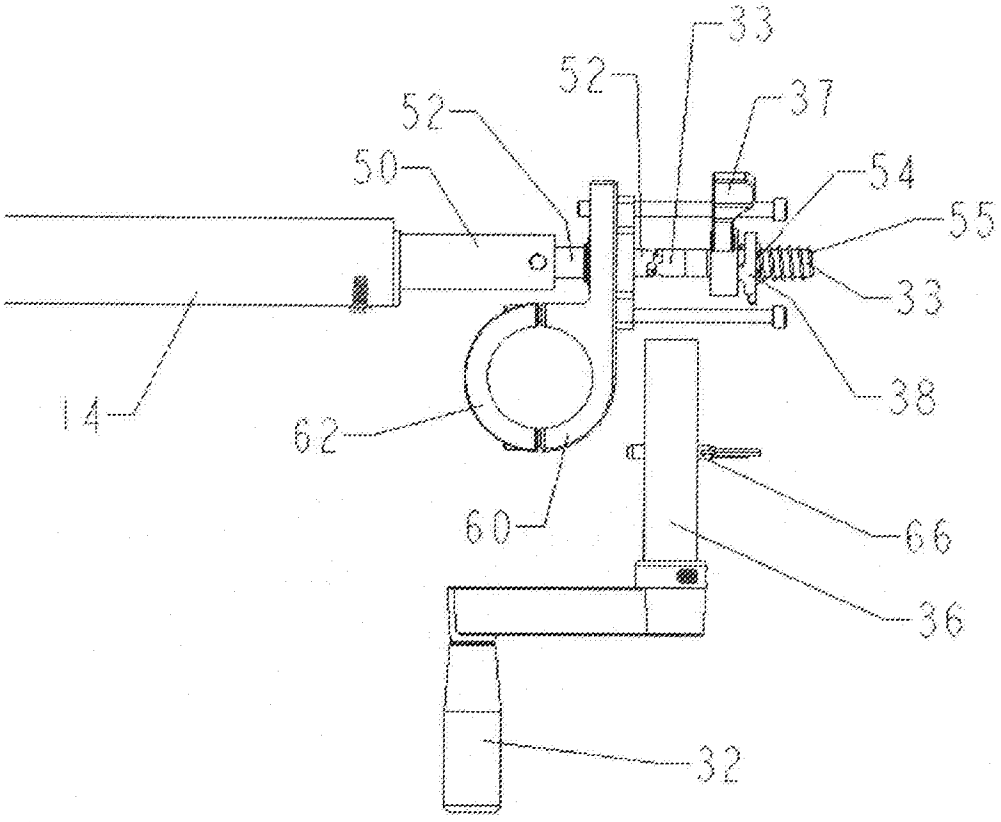
FIG. 17 is an isolated elevational view showing the canvas roller tube with the drive pin of the gear box assembly separated from the pin connector on the end of the gudgeon of the canvas roller, wherein the gear box assembly is disengaged from the roller and the roller is in a free spool mode.
Figure 18:
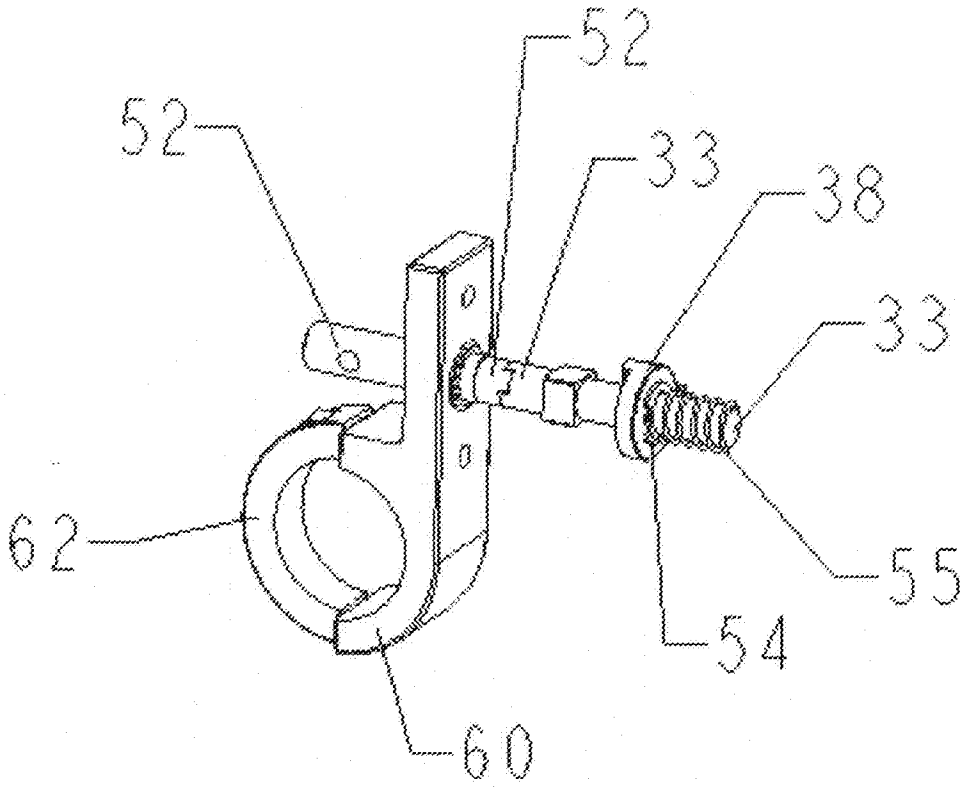
FIG. 18 is an isolated perspective view showing the pin connector engaged with the drive pin of the gear box assembly when the lever is in the down position.
Figure 19:
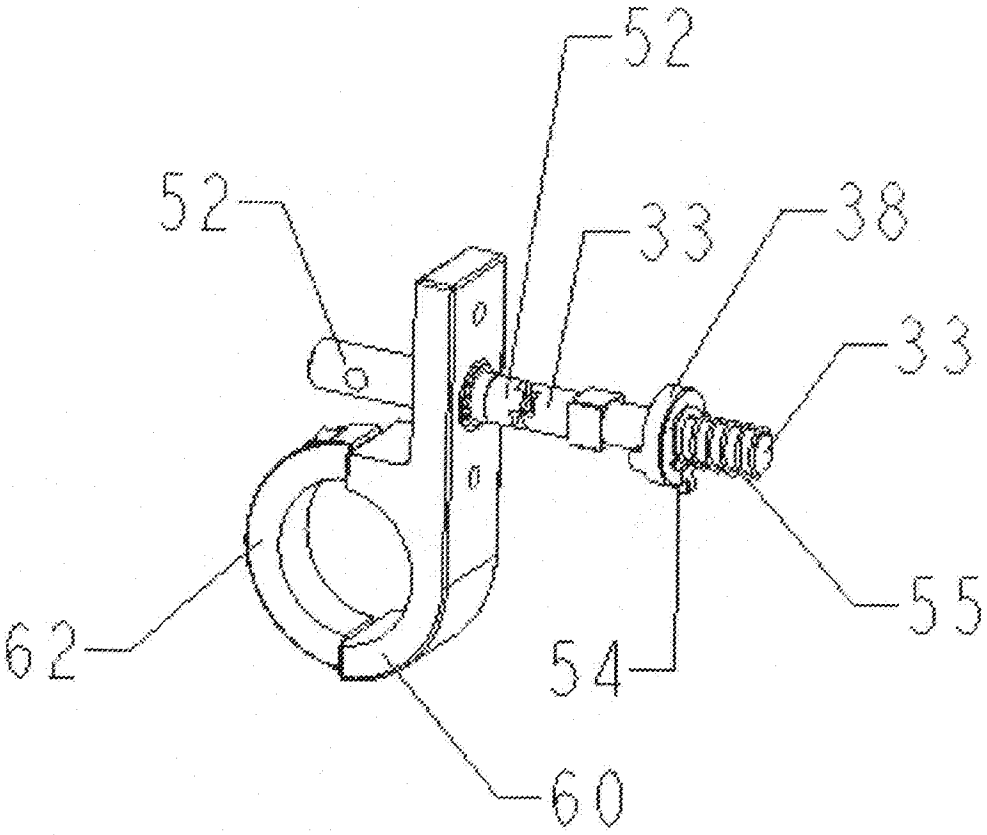
FIG. 19 is an isolated perspective view showing the pin connector disengaged from the drive pin when the lever is in the raised up position and the roller is in the free spool mode.

Referring to FIGS. 10-19, the gear box operation and assembly is illustrated. Specifically, to operate the gear box assembly 30, the lever 37 is rotated clockwise or to the up position, as seen in FIG. 10, which disengages the canvas roller 14. As the lever 37 rotates clockwise, two ramps 70 on the lever 37 (see FIG. 11) engage opposing ramps 72 on the cam 38 (see FIG. 12) which pushes the cam 38 away from the lever 37. As seen in FIG. 13, the cover 56 of the gear box assembly includes ribs 74 on the inside. These two ribs 74 on the cover 56 trap a cam tab 75 on cam 38 (see FIG. 14) so that the cam 38 is not able to rotate within the cover 56. Accordingly, the cam 38 is only able to be pushed away from the lever 37 as the lever rotates clockwise. Referring to FIGS. 15 and 16, as the cam 38 gets pushed away from the lever 37 as the lever rotates clockwise, the sub-assembly of the drive pin 33, cam 38 and the E-clip 54 are pushed away from the lever 37 and pushed against the compression spring 55. As seen in FIG. 17, this results in separation of the drive pin 33 from the pin connector 52 that is fixed to the gudgeon 50 on the canvas roller tube 14. At this stage, the canvas roller tube 14 is in a free spool mode (see FIG. 17). Referring to FIGS. 18 and 19, it is seen that the pin connector 52 and the drive pin 33 are notched for congruent, intermeshing engagement and separation. In FIG. 18, the lever 37 would be in the down position as the pin connector 52 and the drive pin 33 are engaged. When the lever 37 is rotated clockwise to the up position, the pin connector 52 and drive pin 33 are separated and no longer engaged.

Figure 20:
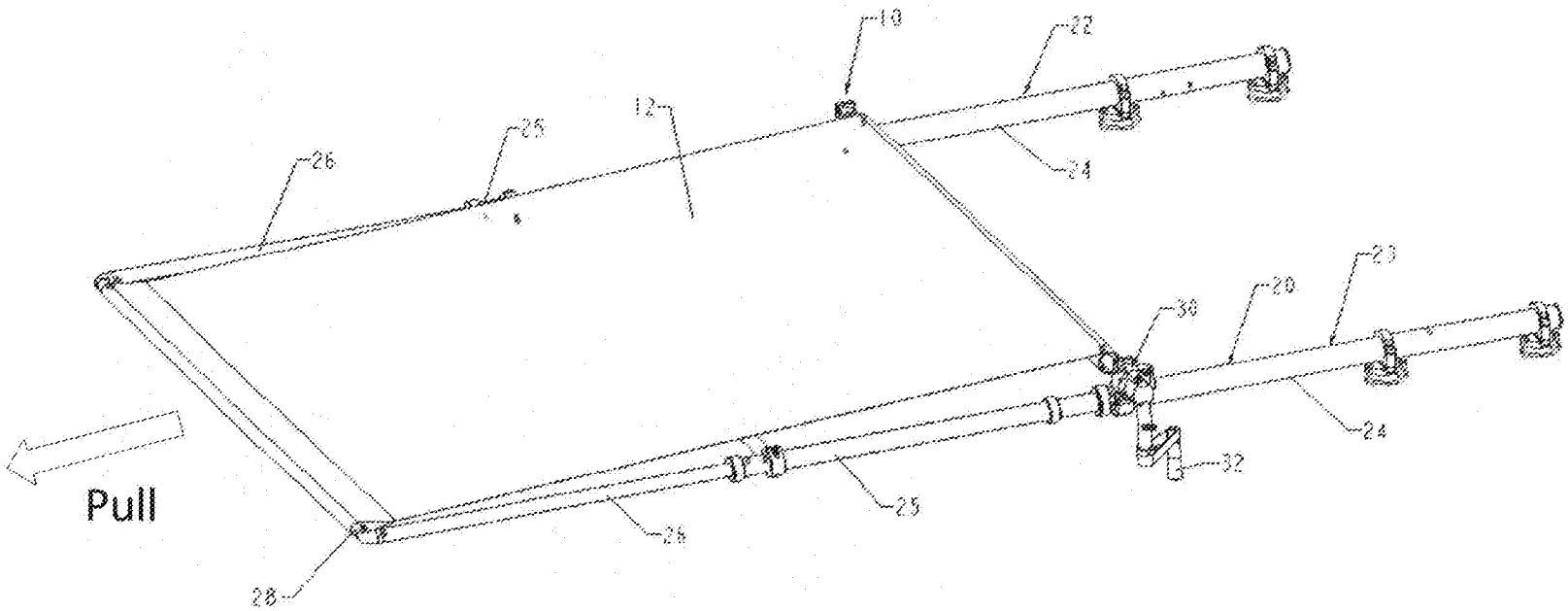
FIG. 20 is an isolated perspective view showing the awning assembly being pulled to the fully extended position.
Figure 21:
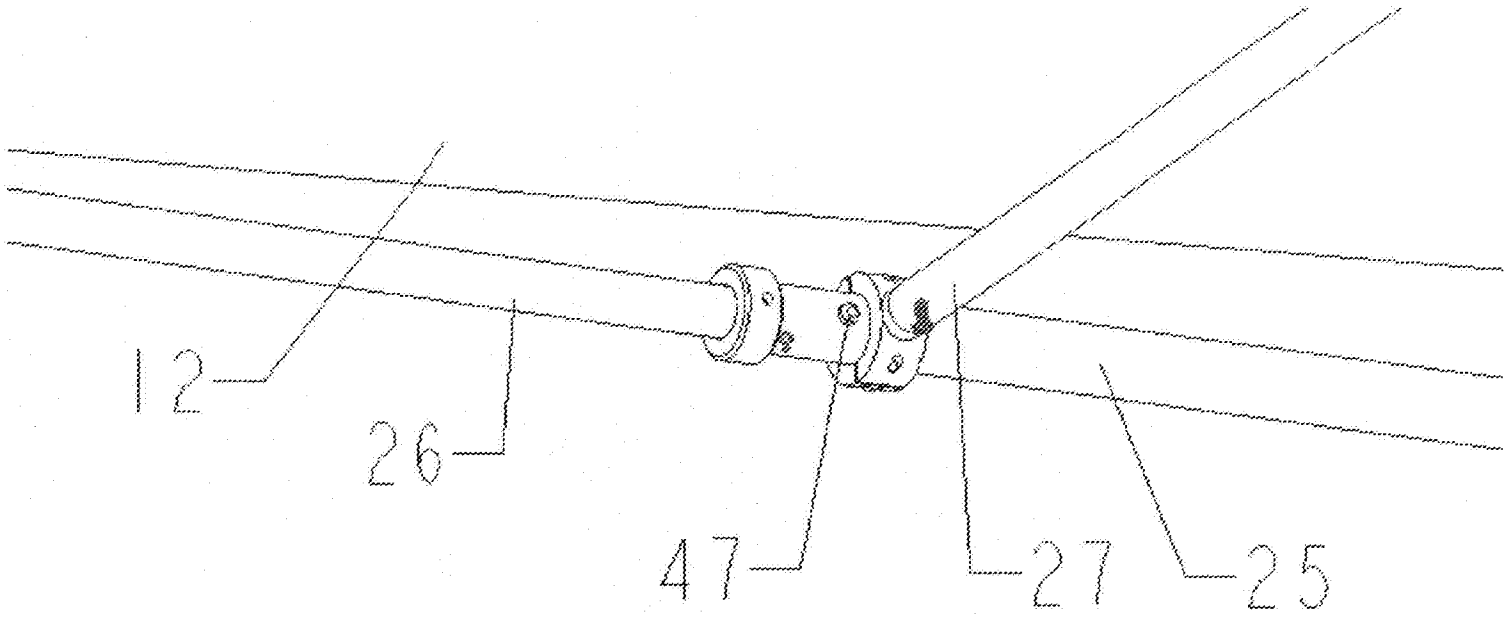
FIG. 21 is an isolated perspective view showing a snap button spring lockingly engaged with the end tube and the mid tube of the telescoping tube assembly when the end tube is fully extended.
Figure 22:
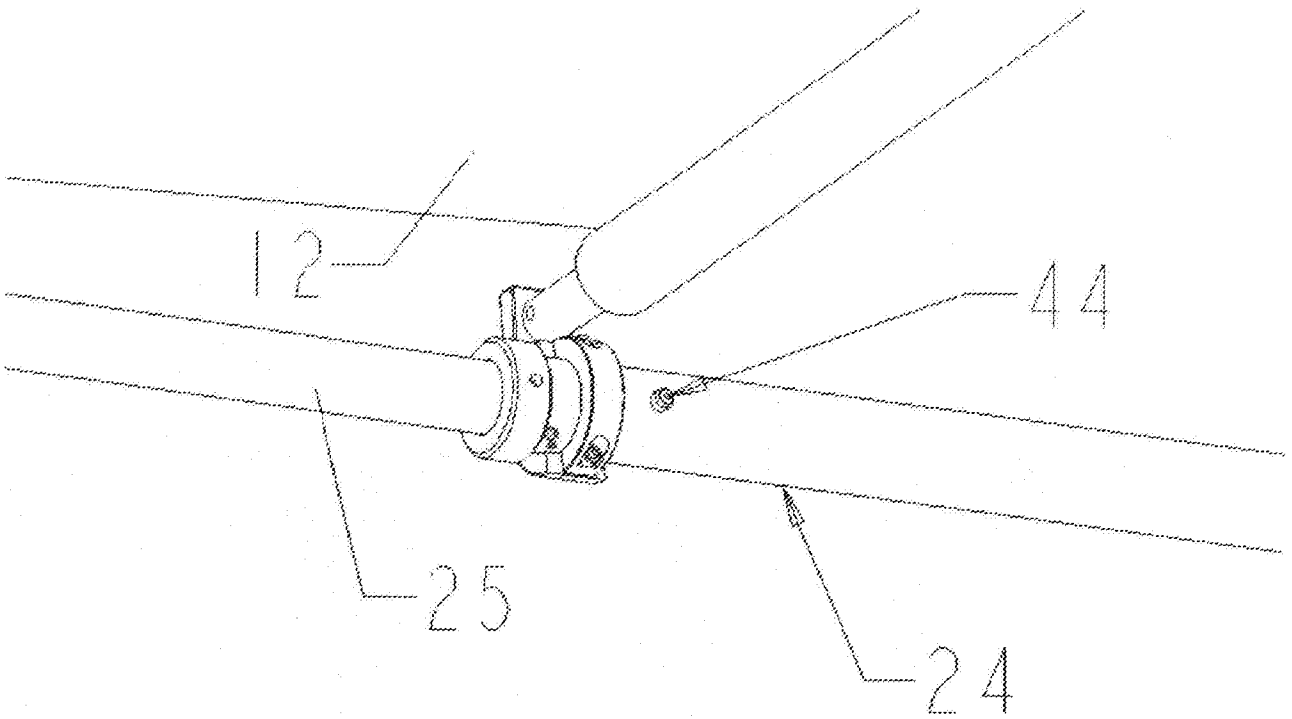
FIG. 22 is an isolated perspective view showing a snap spring button lockingly engaged with the mid tube and the fixed tube when the mid tube is fully extended relative to the fixed tube of the telescoping tube assembly.
Figure 23:
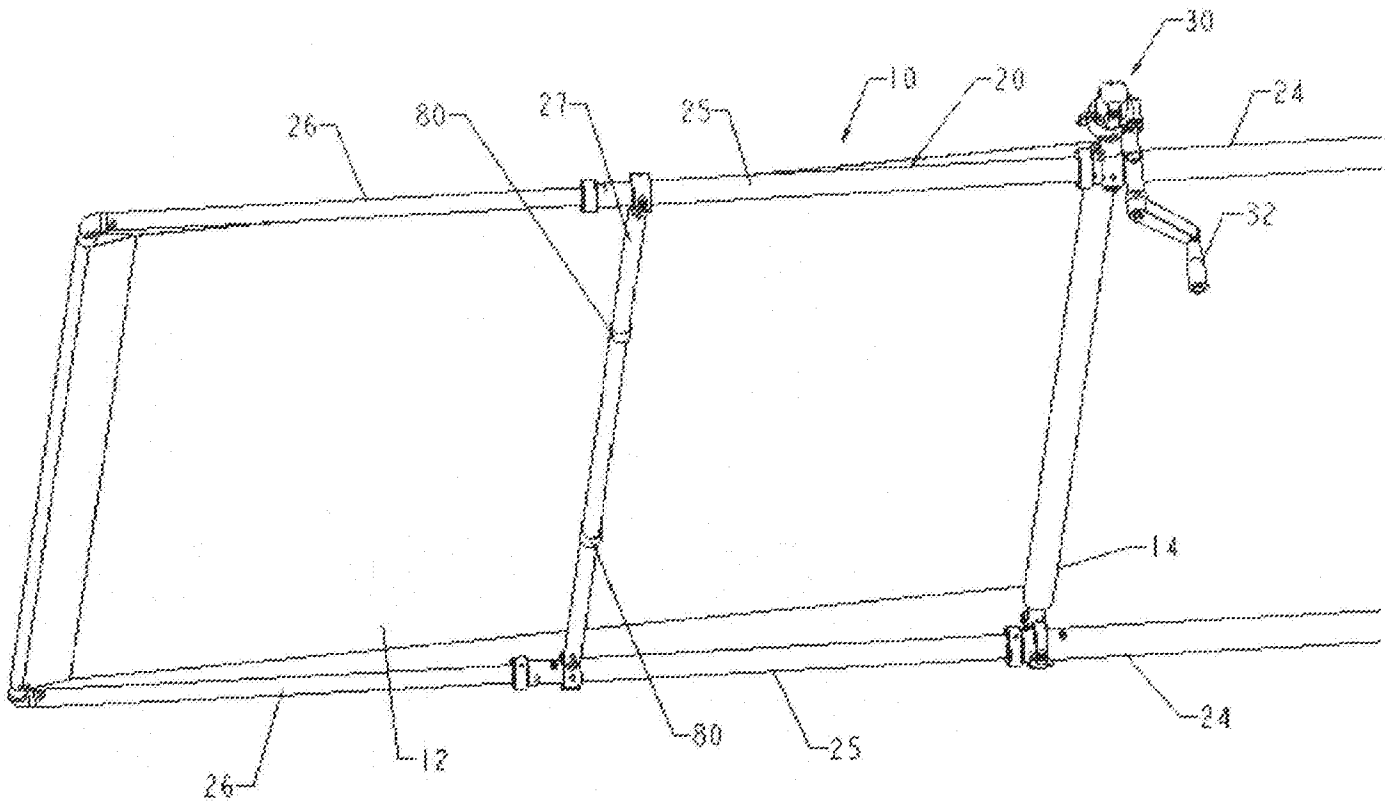
FIG. 23 is a bottom perspective view showing straps on the canvas secured around the mid cross tube with the use of hook and loop releasable fasteners.

To extend the awning assembly 10, the lever 37 is rotated clockwise to the up or raised position. As explained above, this disengages the drive pin 33 from the pin connector 52, placing the canvas roller tube 14 in the free spool mode. At this point, the awning can be extended by manually pulling out on the frame assembly 20 to telescopically extend the tube assemblies 22, 23 and unroll the canvas sheet 12 from the roller tube 14. This can be best accomplished by grabbing the end cross tube 28 of the frame assembly 20 and pulling outwardly, away from the roller tube 14, as shown in FIG. 20. As the end cross tube 28 is pulled outwardly, the mid telescopic tubes 25 and the end telescopic tubes 26 telescopically extend outwardly while the sheet of canvas 12 is unrolled from the roller tube 14. Eventually, the end tubes 26 reach their fully extended limit when the interior sleeve bushing creates a hard stop between the end tubes 26 and the corresponding mid tubes 25. At this point, the snap button springs 47 pop out through the aligned holes in the mid tubes 25 to effectively lock the mid tubes 25 to the corresponding end tubes 26, as seen in FIG. 21. Similarly, the mid tubes 25 reach their fully extended limit outwardly from the fixed tubes as the interior sleeve bushing 48 creates a hard stop between the mid tubes 25 and the fixed tubes 24. At this point, the snap button springs 44 pop out through the aligned holes on the fixed tubes 24 to effectively lock the mid tubes 25 to the fixed tubes 24, as seen in FIG. 22. At this point, the lever 37 on the gear box assembly 30 is rotated counterclockwise to the down position which effectively engages the gear box assembly 30 with the canvas roller tube 14. The crank handle 32 is then rotated to engage the canvas roller 14 with the gear box assembly 30 as the pin connector 52 and drive pin 33 click into engagement with one another. The crank handle 32 is continued to be rotated in order to turn the canvas roller 14 and take up any slack on the canvas 12. Once the canvas 12 is pulled taut, two straps 80 on the bottom of the canvas are secured to the mid cross tube 27 with releasable hook and loop fasteners to keep the canvas 12 from bellowing. At this point, the quick release pin 66 can be removed in order to remove the crank handle 32 from the gear shaft 35 of the gear box assembly 30. The quick release pin 66 can then be reinserted into the crank handle 32 for safe keeping.

Figure 24:
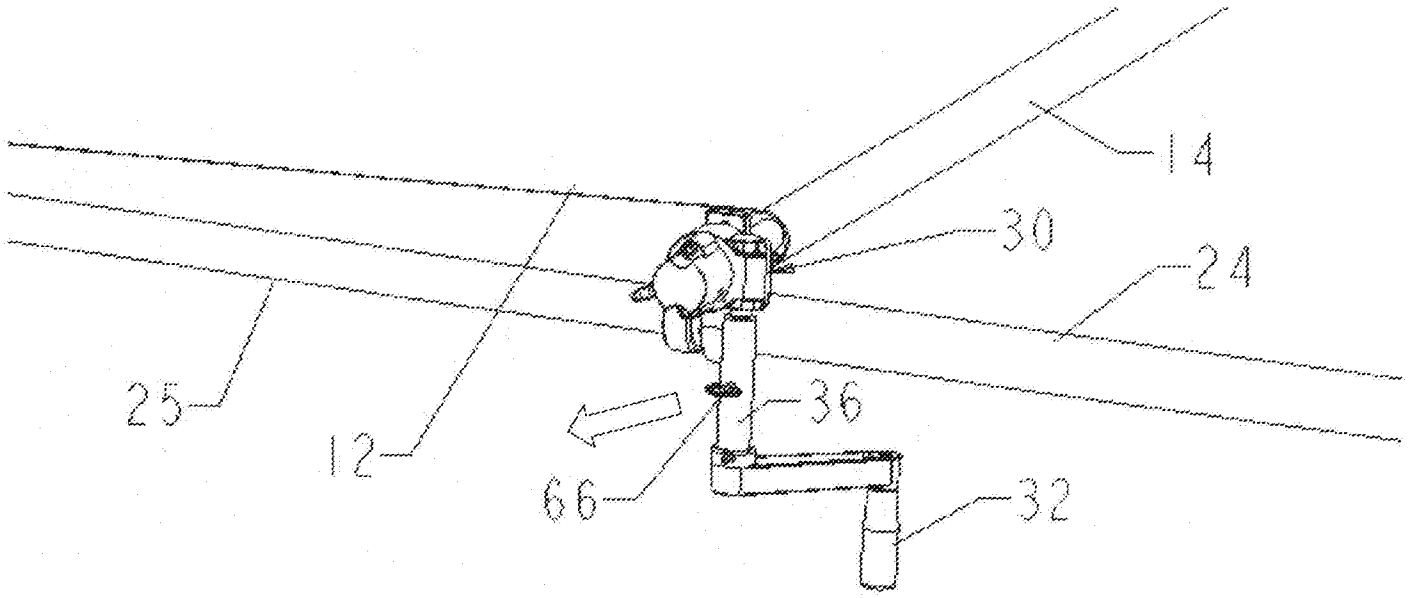
FIG. 24 is an isolated perspective view of the gear box assembly and removable crank handle illustrating removal of a quick release pin for removing the crank handle from the gear box assembly.
Figure 25:
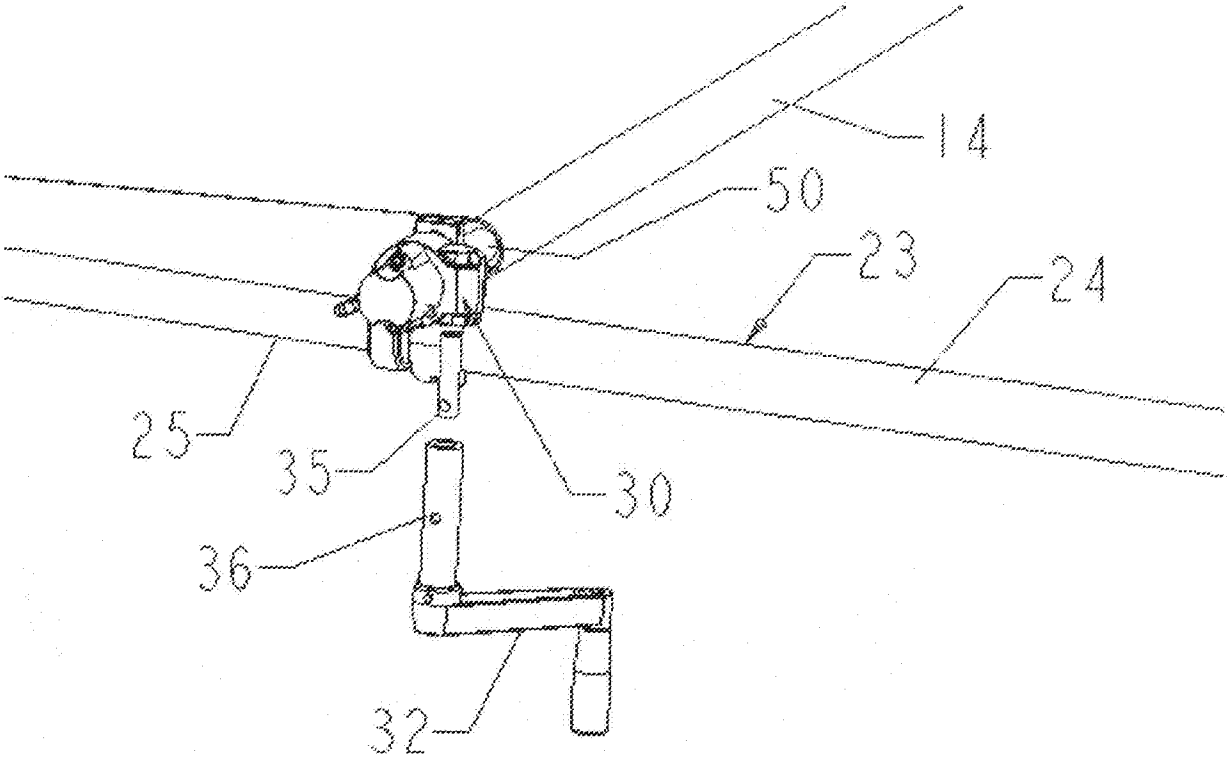
FIG. 25 is an isolated perspective view showing the crank handle removed from the gear shaft of the gear box assembly.

In order to retract the awning assembly 10, the quick release pin 66 is removed from the crank handle 32 and the crank handle is fitted onto the gear shaft 35 of the gear box assembly 30, as seen in FIGS. 24 and 25. The straps on the bottom of the canvas 12 can then be released from the mid cross tube 27 by separation of the hook and loop fasteners. Next, the crank handle 32 is turned in order to release the canvas roller 14 and allow slack in the canvas 12. Next, the snap button springs 47 are pushed in and held while the end tubes 26 are slid into the mid tubes 25 on each side of the frame assembly. Thereafter, the snap button springs 44 are pushed in on each mid tube 25 and the mid tubes are then slid into the fixed tubes 24 on each side of the frame assembly. Once the snap button springs 44, 47 are released and the end tubes are partially slid into the mid tubes and the mid tubes are partially slid into the fixed tubes, the crank handle 32 is turned until the canvas 12 is completely rolled onto the roller 14. As the canvas 12 is rolled onto the canvas roller 14, the end tubes 26 telescopically retract within the mid tubes 25 and likewise, the mid tubes 25 telescopically retract into the fixed tubes 24 until the awning assembly 10 reaches the retracted position as seen in FIG. 1.

While the present invention has been shown in accordance with a preferred and practical embodiment, it is recognized that departures from the instant disclosure are fully contemplated within the spirit and scope of the present invention which is not to be limited except as defined in the following claims.

What is claimed is:

1. An awning assembly for installation on a boat, said awning assembly comprising:

a frame structure including first and second telescopically extendable and retractable tube assemblies positioned and supported in spaced apart parallel relation to one another and each including a fixed tube, a telescopic mid tube and a telescopic end tube, and said frame structure further including a mid cross tube connected to and extending transversely between the mid tubes of the first and second tube assemblies, and an end cross tube connected to and extending transversely between the end tubes of the first and second tube assemblies, and the frame structure being movable between a fully retracted position and a fully extended position;

a roller supported transversely between the fixed tubes of the first and second tube assemblies, and the roller being rotatable in a first direction and an opposite second direction;

a sheet of canvas having a first end secured to the roller and an opposite second end secured to the end cross tube, and the canvas sheet being adapted to be rolled onto the roller when the roller is rotated in the first direction and unrolled from the roller when the roller is rotated in the second direction;

a gear box assembly mounted to the frame structure and including a gear shaft, and the gear box being driven by rotation of the gear shaft, and the gear box assembly being operable to selectively engage with the roller and rotate the roller in the first direction upon driven rotation of the gear shaft, and the gear box assembly being further operable to selectively disengage from the roller to allow free spool rotation of the roller in either the first direction or the second direction;

the gear box assembly further including a drive pin and a pin connector, the pin connector being structured for fixed attachment to an end of the roller, and wherein the drive pin and the pin connector are structured and disposed to be operably moved into driven engagement with one another to engage the gear box assembly with the roller, and further wherein the drive pin and the pin connector are structured and disposed to be operably disengaged from one another to thereby disengage the gear box assembly from the roller;

the gear box assembly further including a lever and a cooperating cam, the cam being fixed to the drive pin and wherein movement of the lever from a first position to a second position urges the cam in a direction to effectively disengage the drive pin from the pin connector and thereby disengaging the gear box assembly from the roller;

the gear box assembly further including a compression spring for urging the drive pin into engagement with the pin connector upon movement of the lever from the second position to the first position to thereby engage the gear box assembly with the roller, wherein the lever and the cam each include cooperating ramps that are structured and disposed to urge the cam away from the lever and against the force of the compression spring upon movement of the lever from the first position to the second position, thereby effectively disengaging the gear box assembly from the roller;

a crank handle attached to the gear shaft for manually rotating the gear shaft and driving operation of the gear box assembly; and wherein the gear box is selectively disengaged from the canvas roller to allow the frame structure to be manually extended while rotating the roller in the second direction as the canvas sheet is unrolled from the roller and extended with the frame structure, and further wherein the gear box assembly is selectively engaged with the roller to allow retraction of the frame assembly and canvas sheet as the crank handle is operated to rotate the gear shaft and drivingly operate the gear box assembly causing the roller to be drivingly rotated in the first direction as the canvas sheet is wound onto the roller and thereby pulling the frame assembly to the retracted position as the first and second tube assemblies telescopically retract.

2. The awning assembly as recited in claim 1 wherein the telescopic mid tubes and the telescopic end tubes of the first and second telescopically extendable and retractable tube assemblies are structured to releasably lock when the frame structure is at the fully extended position.

3. The awning assembly as recited in claim 2 wherein the telescopic mid tubes of the first and second telescopically extendable and retractable tube assemblies each include snap button springs for releasable interlocked engagement with the corresponding fixed tubes, and the telescopic end tubes of the first and second telescopically extendable and retractable tube assemblies each include snap button springs for releasable interlocked attachment with the corresponding mid tubes when the frame structure reaches the fully extended position.

4. The awning assembly as recited in claim 1 wherein the crank handle is removably attachable to the gear shaft of the gear box assembly.

5. The awning assembly as recited in claim 1 wherein the frame structure is adapted to be manually pulled out from the fully retracted position to the fully extended position by pulling the end cross tube outwardly in a direction away from the roller, wherein the frame structure is extended to the fully extended position while the sheet of canvas is unrolled from the roller.

6. An awning assembly for installation on a boat, said awning assembly comprising:

a frame structure including a proximal end and an opposite distal end, and an end cross tube at the distal end, and the frame structure being movable between a fully retracted position and a fully extended position;

a roller supported transversely on the frame structure, and the roller being rotatable in a first direction and an opposite second direction;

a sheet of canvas having a first end secured to the roller and an opposite second end secured to the end cross tube, and the canvas sheet being adapted to be rolled onto the roller when the roller is rotated in the first direction and unrolled from the roller when the roller is rotated in the second direction;

a gear box assembly mounted to the frame structure and including a gear shaft, and the gear box being driven by rotation of the gear shaft, and the gear box assembly being operable to selectively engage with the roller and rotate the roller in the first direction upon driven rotation of the gear shaft, and the gear box assembly being further operable to selectively disengage from the roller to allow free spool rotation of the roller in either the first direction or the second direction;

the gear box assembly further including a drive pin and a pin connector, the pin connector being structured for fixed attachment to an end of the roller, and wherein the drive pin and the pin connector are structured and disposed to be operably moved into driven engagement with one another to engage the gear box assembly with the roller, and further wherein the drive pin and the pin connector are structured and disposed to be operably disengaged from one another to thereby disengage the gear box assembly from the roller;

the gear box assembly further including a lever and a cooperating cam, the cam being fixed to the drive pin and wherein movement of the lever from a first position to a second position urges the cam in a direction to effectively disengage the drive pin from the pin connector and thereby disengaging the gear box assembly from the roller;

the gear box assembly further including a compression spring for urging the drive pin into engagement with the pin connector upon movement of the lever from the second position to the first position to thereby engage the gear box assembly with the roller, wherein the lever and the cam each include cooperating ramps that are structured and disposed to urge the cam away from the lever and against the force of the compression spring upon movement of the lever from the first position to the second position, thereby effectively disengaging the gear box assembly from the roller; and wherein the gear box is selectively disengaged from the canvas roller to allow the frame structure to be manually extended while rotating the roller in the second direction as the canvas sheet is unrolled from the roller and extended with the frame structure, and further wherein the gear box assembly is selectively engaged with the roller to allow retraction of the frame assembly and canvas sheet as the gear shaft is rotated to drivingly operate the gear box assembly.

* * * * *